United States Patent [19]

Tarassoff

[11] Patent Number: 4,669,389

[45] Date of Patent: Jun. 2, 1987

[54] AERIAL ROPEWAY TRANSPORT INSTALLATION WITH SEVERAL SECTIONS

[75] Inventor: Serge Tarassoff, Seyssinet, France

[73] Assignee: Pomagalski S.A., France

[21] Appl. No.: 782,395

[22] Filed: Oct. 1, 1985

[30] Foreign Application Priority Data

Oct. 15, 1984 [FR] France ..... 84 15866

[51] Int. Cl.[4] ..... B61B 11/00

[52] U.S. Cl. ..... 104/173.2; 104/178

[58] Field of Search ..... 104/163, 173 ST, 173 R, 104/178, 173.2

[56] References Cited

U.S. PATENT DOCUMENTS 3,541,962 11/1970 Avery ..... 104/178

4,401,034 8/1983 Gaudet ..... 104/178

FOREIGN PATENT DOCUMENTS 0114129 7/1984 European Pat. Off. .

558357 9/1932 Fed. Rep. of Germany .

630022 5/1936 Fed. Rep. of Germany .

*Primary Examiner*—Robert B. Reeves

*Assistant Examiner*—David F. Hubbuch

*Attorney, Agent, or Firm*—Parkhurst & Oliff

[57] ABSTRACT

A detachable gondola lift or chair-lift is disclosed which includes several sections which can operate independently from one another. Two sections are connected in an intermediate station by connecting tracks to transfer cars from one section to the other. Each section is equipped with a chain to drive the cars on the transfer rails. Each section is also fitted with flowrate regulators. When the two sections are joined, an adjustment device adjusts the chain of one of the sections in relation to the chain of the other section to achieve a regular transfer of the cars from one section to the other without intermediate storage.

8 Claims, 4 Drawing Figures

AERIAL ROPEWAY TRANSPORT INSTALLATION WITH SEVERAL SECTIONS

BACKGROUND OF THE INVENTION

The invention relates to an aerial ropeway transport installation having at least two sections connected in series by an intermediate station, each section having an aerial ropeway continuously driven by a motor and extending between two stations in a closed circuit.

An installation of the kind mentioned avoids unloading passengers in the intermediate station or stations. A car passing from one of the sections to the next runs on a connecting track joining the two sections. In the intermediate station the cars advance irregularly and it is inevitable for cars to crash into one another and pile up one behind the other; these impacts are detrimental to the equipment and to the people transported and slow the flowrate down.

U.S. patent application Ser. No. 570,687 of 01/13/1984, now U.S. Pat. Nos. 4,627,361, and 755,470 of 07/16/1985 filed by the applicant have made flowrate regulation systems known which make the running of cars or chairs on a section smooth and also ensure a regular flowrate and an even distribution of the cars along the rope.

The object of the present invention is to enable such flowrate regulators to be adapted to an installation of the kind mentioned hereabove with several sections in series and to ensure smooth running of the cars in the intermediate stations.

SUMMARY OF THE INVENTION

The installation according to the invention comprises a means of detecting the flowrate of the cars on one of the sections, a means of detecting the flowrate of the cars on the other section, an adjustment device actuated by said flowrate detection means and fitted with a unit displaying a preset stagger to generate a signal to adjust one of the flowrate regulating means when a difference occurs between the displayed stagger figure and the stagger measured by said detection means, to achieve continuous running of the cars from one of the sections to the other without them being stored in the station.

Each section can operate independently one from the other, the passengers disembarking in each station, whereas the car detached from the rope runs at low speed on a return circuit to the rope return track, to which it is reattached on leaving the station. The passengers who take the next section embark in a car of this second section and so on; each section operates at a rate regulated by its flowrate regulating means.

When an order to couple the sections in series is received, the adjustment device according to the invention is actuated to ensure that the flowrates of the cars on the two sections are identical and to adjust one section in relation to the other, in such a way that a car leaving one of the sections, once it has passed over the connecting track, reaches the other section at the right moment to be taken up by the driving system of the latter section. The stagger depends of course on the length of the connecting track and on the time taken thereon to pass from one section to the other and this stagger value is, for example, determined by tests.

All the cars must arrive within a deviation time admissible by the flowrate regulator, which then corrects the deviations.

The device for driving the cars in the stations can be of any kind, for example a chain and pin or friction or gravity wheel system, these devices not necessarily being the same in all the stations.

In the case of a chain and pin system, a mark is made on the chain and this mark is detected when it passes a predetermined spot, for example by a proximity detector, a microcontact actuated by a push-button, a photoelectric cell or any other operating system. The stagger required for correct operation is displayed and the deviation between the passage of the mark on the first section and that of the second section is monitored, and should correspond to the displayed stagger. When one chain gets behind, all that has to be done is, for example, to temporarily accelerate the drive chain which is behind to reestablish the correct stagger of one chain in relation to the other or to slow down the chain which is ahead, etc . . . The drive chains should preferably but not necessarily be driven at the same speed, as should the aerial ropes of the different sections. When the driving movement of the transfer chains is derived from that of the rope, the adjustment device according to the invention regulates the speed of the rope and thereby indirectly that of the associated chain. To this end it is sufficient to control the main motor speed regulator by means of the adjustment device.

A section can have two flowrate regulating devices, one in each of the stations, as described in the abovementioned patent applications, but in most cases one regulating device per section is sufficient to compensate for an uneven flow. In this case the movement of the flowrate regulation system is picked up on one of the main rope bull-wheels. The arrangement of the flowrate regulators and the motors of the two sections in the intermediate station facilitates the power supply and control of the sections.

According to an embodiment of invention, the flowrate regulating section comprises a first means of driving the cars by fixed pins on the transfer chain, extending along the half-loop car return circuit to the return track, and a second drive means by friction wheels at a slightly different speed. The car is taken up, after it has decelerated, by one of the fixed or retractable pins of the chain without a noticeable stop and is driven at reduced speed to the flowrate regulating section, preferably situated just before the section where the cars are accelerated and recoupled on the rope. At the entry to the flowrate regulating section, a cam raises or retracts the retractable pins and the outgoing flowrate is imposed by the fixed pins in the manner described in the previously mentioned patent applications.

Correct adjustment on the up track does not necessarily correspond to correct adjustment on the down track and according to the invention a corresponding correction is provided by adjustment of the transfer chain without the flowrate regulating means.

BRIEF DESCRIPTION OF THE DRAWINGS

Other advantages and characteristics of the invention will become more clearly apparent from the description which follows of an embodiment of the invention, given as an example only and represented in the accompanying drawings, in which.

BRIEF DESCRIPTION OF THE PREFERRED EMBODIMENTS

Figure 1:
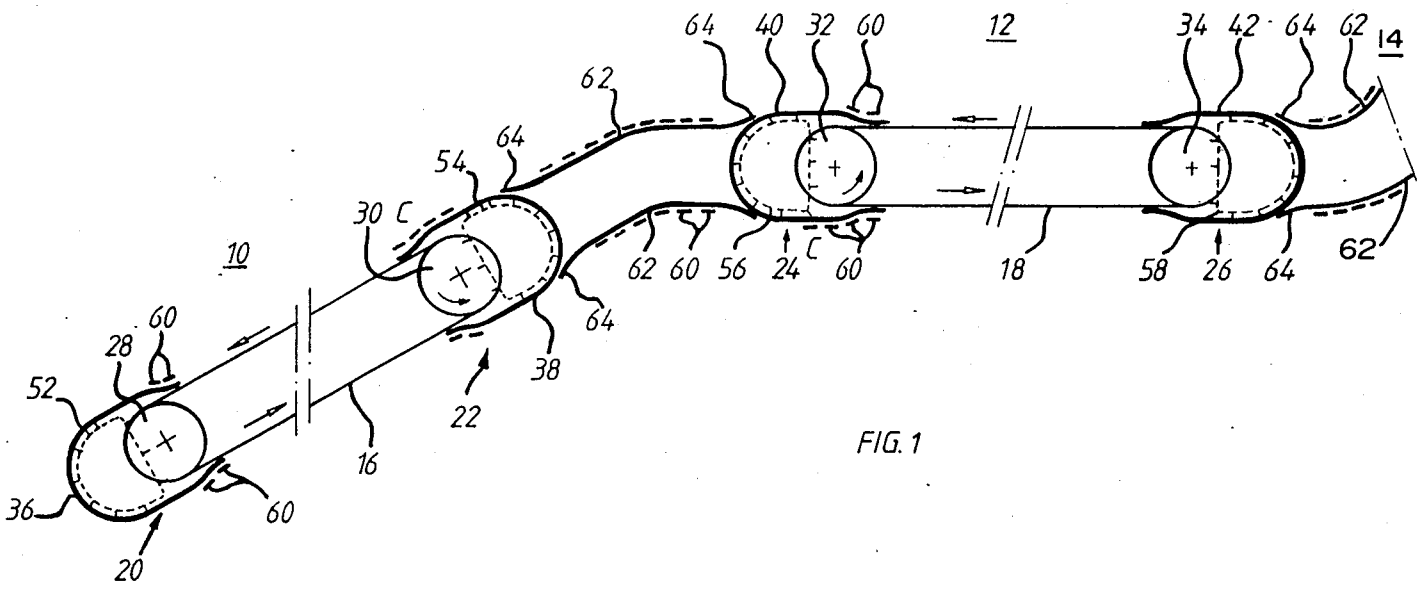
FIG. 1 is a schematic plan view of a chair lift with several sections according to the invention.

In the figures, an aerial ropeway transport installation, for example, a single or double-cable detachable gondola lift or chair lift, comprises three successive sections 10, 12, 14, only the beginning of the third section 14 being sketched in on the drawing. The number of sections may be different, notably two. The sections 10, 12, 14 are of a standard type each having a hauling or hauling-carrier rope 16, 18, extending in a closed loop between two uphill and downhill stations 20, 22, 24, 26 running on return bull-wheels 28, 30, 32, 34. Each station includes a transfer rail 36, 38, 40, 42 in a half-loop connecting the two sections of the rope 16, 18. A carriage 46 supporting a car 48 by means of a hanger arm 47 is coupled to the rope 16, 18 by means of a grip 44, said grip 44 being of the detachable type to detach the carriage 46 on entering the stations 20–26 by the action of a cam 49 and the carriage 46 running on the rail 36–42 by means of wheels 50. A chain 52, 54, 56, 58 fitted with pins extends along each rail 36–42 to drive the carriages 46 in the station at reduced speed to load and unload the passengers. At the exit from the stations 20–26 tired friction wheels 60 cooperate with a track 61 of the carriage 46 to accelerate it up to the speed of the rope 16, 18 before coupling it onto the latter. At the entry into the station similar wheels 60 can slow the carriage detached from the rope.

Two successive sections 10, 12; 12, 14 are joined by connecting tracks 62, which are connected by points 64 to the corresponding transfer rails 38, 40, 42, for the carriages to pass from one section to the other on both the up and down journeys. Friction wheels 60 are fitted along the connecting tracks 62 to drive the carriages 46.

It is pointless giving a detailed description of such an installation, which is well known to specialists, and it is sufficient to recall that each section 10, 12, 14 can operate independently from one another, the points 64 then being in the inactive position, in order not to run the carriages 46 off onto the connecting tracks 62. The sections 10, 12, 14 can also be connected in series by switching the points 64 to the active position to transfer the carriages 46 from one section to the next on both the up and down journeys.

Figure 2:
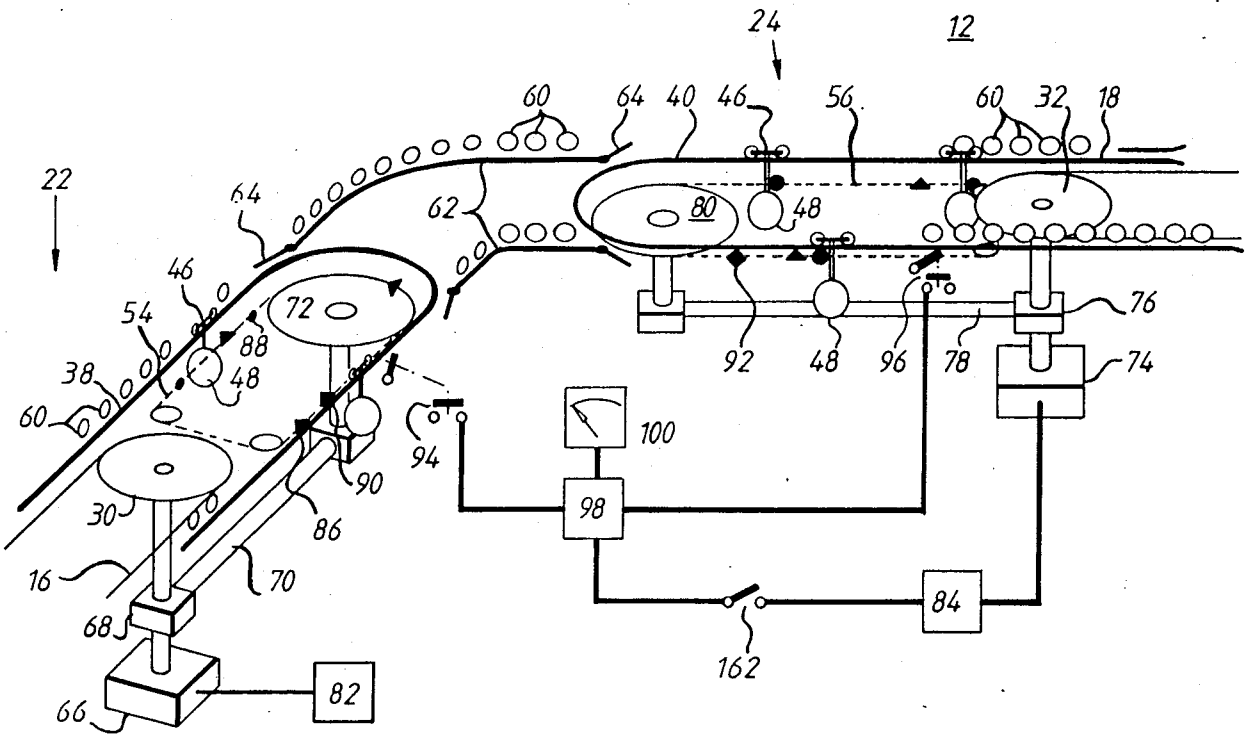
FIG. 2 is a schematic perspective view of an intermediate station in FIG. 1.
Figure 3:
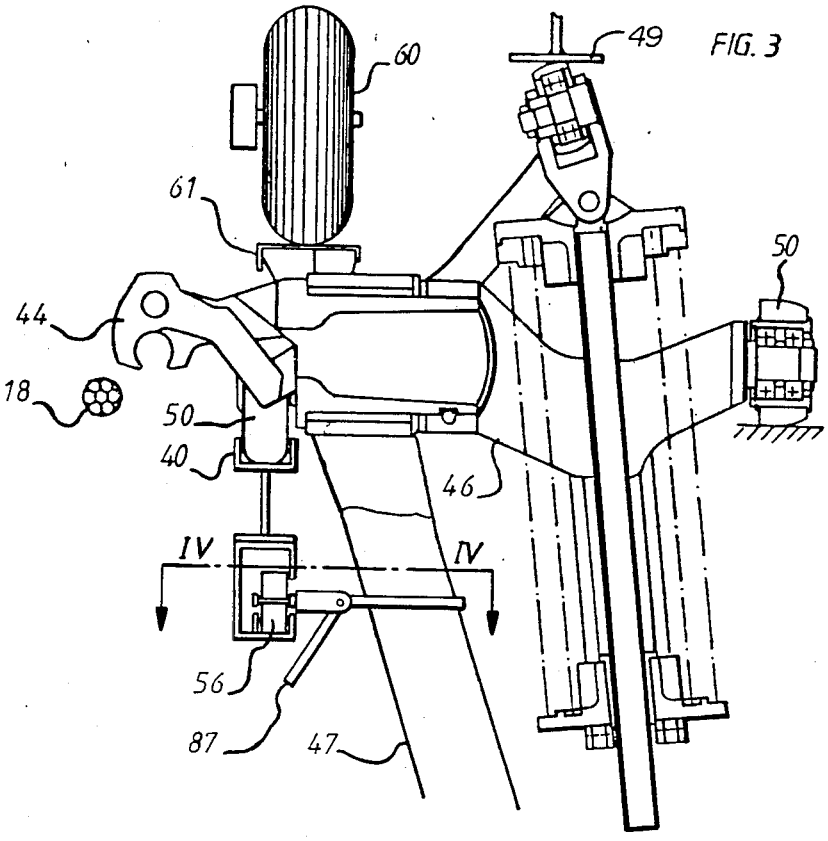
FIG. 3 is a cross-sectional view of a car carriage engaged on a flowrate regulating section.
Figure 4:
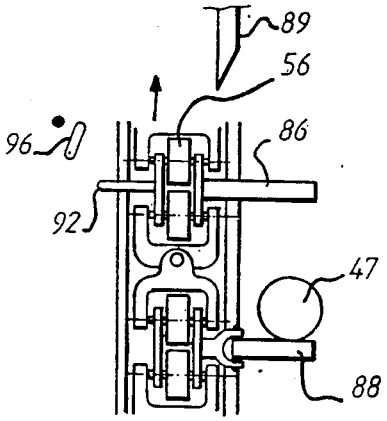
FIG. 4 is a cross-section along the line IV—IV of FIG. 3 illustrating a transfer chain with retractable and fixed pins.

Two adjacent stations 22, 24 of successive sections 10, 12 constitute an intermediate station represented in greater detail in FIG. 2. The wheel 30 of the rope 16 is a drive wheel driven in rotation by an electric motor 66 via a reducer 68. The reducer 68 drives by means of a reducer transmission 70, which is for example mechanical, a wheel 72 driving the chain 54 fitted with pins. Similarly, the wheel 32 of section 12 is driven by a motor 74 and a reducer 76, the latter in turn driving, by means of a reducer transmission 78, a wheel 80 of the chain 56 fitted with pins. The motors 66, 74 are supplied with direct current at an adjustable speed by power supply units 82, 84. The chains 54, 56 run at geared down speed, respectively in synchronism with the ropes 16, 18.

The rail 38 of the station 22 and the rail 40 of the station 24 each comprise a flowrate regulating section C fitted with two drive means, in this instance friction wheels 60 and fixed pins 86, represented by triangles on the chains 54, 56. The other pins 88 of the chain, represented by rectangles, are retractable and have a tail-piece 87 cooperating with a clearing cam 89 which extends along the flowrate regulating section C.

The chain 54, 56 runs, for example at a slightly greater speed than the circumferential speed of the friction wheels 60 and driving by the chain takes priority. Flowrate regulating sections of this kind are described in the above-mentioned patent applications and enable the flowrate of the carriages 46 to be regulated each time they pass, to keep their distance apart regular without storing cars in the station. A carriage 46 which has reached a maximum distance behind along the track is taken up by a fixed pin 86 and is driven at fast speed over the whole regulating section C. A carriage 46 which is a maximum distance ahead is taken up by a retractable pin 88, which retracts on entering the regulating section C. The carriage 46 is then driven at low speed by the friction wheels 60 until it is caught up by the following fixed pin 86, which comes in at the end of the regulating section C. In an intermediate position, the carriage 46 is taken up during its passage over the section more or less quickly depending on whether it is ahead or behind. It is clear that the flowrate regulating system can be of a different kind, for example described in the above-mentioned patent applications. The flowrate regulating sections C are located just before the section where the carriages 46 are accelerated at the end of the rails 38, 40 but it is obvious that other layouts can be used and that a flowrate regulating system can be fitted in each of the stations 20, 26.

According to the present invention, the chains 54, 56 fitted with pins bear a mark 90, 92 represented by a diamond, which as it passes actuates a microcontact 94, 96 or any other detection means. The microcontacts 94, 96 are connected to a comparator unit 98 having a stagger display 100. The unit 98 measures the time interval between the signals emitted by the microcontacts 94, 96 and compares it with the stagger figure displayed to generate a regulation signal applied to the adjustable speed power supply unit 84 of the motor 74. It can easily be understood that the signals from the microcontacts 94, are representative of the movement and of the relative position of the chains 54, 56 and thereby of the flowrate of the carriages 46 on the sections 10, 12 and of the difference in these rates.

The adjustment device according to the invention operates as follows:

In independent operation of the sections 10, 12, the connection between the comparator unit 98 and the power supply unit 84 is broken, by opening of a switch 162, and the sections 10, 12 operate each at their own rhythm. To join the sections, the correct stagger figure must be displayed on the unit 100 beforehand and this initial adjustment is achieved by tests with the purpose of adjusting the chain 56 in relation to the chain 54, in such a way that a carriage 46 which is a maximum distance behind on the section 10, and therefore driven by a fixed pin 86 of the chain 54, passes over the connecting track 62 and reaches the section 12 at the right time to be taken up by a fixed pin 86 of the chain 56. The correct flowrate is then reestablished during the run over the flowrate regulating section C of the section 12. In practice a safety margin should be allowed for taking account of slight deviations which may occur during the passage over the connecting track 62. It is clear that a correct stagger for the carriages 46 which are a maximum distance behind is also correct for all the others.

When the stagger figure has been set and displayed on the unit 100 and the two sections 10, 12 are operating separately, the switch 162 is closed when a connection order is given. The unit 98 measures the deviation between the signals 94, 96, for example the time interval or running length between closing of the microcontacts, and compares this deviation with the figure displayed. If the deviation is lower than the figure displayed, the unit 98 sends an acceleration order to the motor 14 and thus to the chain 56, causing the deviation to increase until a correct adjustment is obtained, and vice-versa if the deviation is greater than the figure displayed. It then only remains to set the points 64 to the active position to make the connection.

It can be understood that the regulation system 94, 100 synchronizes the sections 10, 12, the ropes 16, 18 as well as the chains 54, 56 all running at the same speed. The chains 54, 56 are moreover staggered or out of phase by a value preset by the display.

Adjustment and regulation can be limited to the chains 54, 56 if the latter are fitted with a driving means independent from the rope 16, 18. If the flowrate is set by another driving means than the chain, the adjustment is made on this other driving means. It can be seen that one of the sections, in this instance section 10, pilots all the other sections of the installation.

To maintain correct adjustment on the return track it is possible to adjust the speeds of the chains 52 not fitted with flowrate regulators, all these adjustments being carried out on installation and checked periodically.

What is claimed is:

1. Aerial ropeway transport installation, comprising: at least two sections and four stations, two of which are end stations and two of which are adjacent stations which form an intermediate station connecting the at least two sections in series, each section having an aerial ropeway extending between an end station and the intermediate station in a closed circuit, at least one motor driving a respective rope of each of said at least two sections continuously, cars or chairs which are coupled to the rope on the sections and detached from the rope in the stations, and transfer circuits fitted in the stations on which the cars or chairs detached from the rope run, each of said transfer circuits comprising a flowrate regulating section, fitted with flowrate regulating means to impose a regular frequency on the cars as they leave said section independently from their frequency on entering said section, the two sections being designed to operate selectively according to a first mode of operation, independently from one another, in which a number of the cars run in a closed circuit on one of the sections and the remainder of the cars run in a closed circuit on the other section, and according to a second mode of coupling in series in which the cars of one of the sections are transferred to the other section in the intermediate station, said installation also comprising a means of detecting the flowrate of the cars on one of the sections, a means of detecting the flowrate of the cars on the other section, an adjustment device actuated by said flowrate detection means and fitted with a unit displaying a preset stagger to generate an adjustment signal of one of the flowrate regulating means when a difference occurs between the stagger figure displayed and the stagger measured by said detection means, so as to achieve a continuous flow of the cars from one of the sections to the other without storing them in the station.

2. Installation according to claim 1, wherein said adjustment device regulates said flowrate regulating means to achieve an identical flowrate of the cars on the two sections with a preset stagger of the flowrate regulating means adapted to the transfer time of the cars from one of the sections to the other.

3. Installation according to claim 1, wherein each section comprises a single flowrate regulating means located in one of the stations of the installation.

4. Installation according to claim 3, wherein the drive motor and the flowrate regulating means of each section are located in an intermediate station.

5. Installation according to claim 1, wherein the flowrate regulating means drive is derived from the movement of the aerial rope, adjustment of the flowrate regulating means being achieved by a temporary acceleration or deceleration of the rope drive to establish or reestablish the preset stagger.

6. Installation according to claim 1, wherein the flowrate regulating means comprises a chain with pins which drive the cars, bearing a mark the passage of which is detected by said detection means to determine the adjustment of the flowrate regulating means.

7. Installation according to claim 6, wherein said chain comprises fixed pins and retractable pins for driving the cars in the station, the retractable pins being retracted on the flowrate regulating section which comprises a second drive means comprising friction wheels to reestablish the flowrate.

8. Installation according to claim 7 having a cam located along the flowrate regulating section to make the retractable pins of the chain retract on the flowrate regulating section.

* * * * *